US007011616B2

(12) United States Patent
Mamberer et al.

(10) Patent No.: US 7,011,616 B2
(45) Date of Patent: Mar. 14, 2006

(54) CUTTING CYLINDER FOR CROSSCUTTING A PRINTING MATERIAL WEB IN A ROTARY PRESS

(75) Inventors: Hans-Eckhard Mamberer, Königsbrunn (DE); Heinz Roettger, Aystetten (DE); Ulrich Rohrhirsch, Unterroth (DE); Franz Rumesz, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/858,725

(22) Filed: Jun. 1, 2004

(65) Prior Publication Data

US 2004/0254055 A1 Dec. 16, 2004

(30) Foreign Application Priority Data

Jun. 12, 2003 (DE) ..... 103 26 976

(51) Int. Cl.
*B31B 1/14* (2006.01)

(52) U.S. Cl. ..... 493/365; 493/361; 493/366; 493/199; 83/343; 83/345

(58) Field of Classification Search ..... 493/424, 493/428, 431, 432, 365, 445, 471, 361, 366, 493/402, 403, 199, 107; 83/343–348, 331
See application file for complete search history.

(56) References Cited

U.S. PATENT DOCUMENTS

| | | | | |
|---|---|---|---|---|
| 2,555,267 A | * | 5/1951 | Crafts | 493/357 |
| 3,521,878 A | * | 7/1970 | Bolza-Schunemann | 493/429 |
| 4,159,823 A | * | 7/1979 | Bryer et al. | 493/369 |
| 5,049,120 A | * | 9/1991 | Prum | 493/342 |
| 5,622,113 A | | 4/1997 | Hansen | |

FOREIGN PATENT DOCUMENTS

| | | |
|---|---|---|
| DE | 76 38 883 | 8/1978 |
| DE | 27 04 813 | 8/1985 |
| DE | 92 04 602 | 7/1992 |

* cited by examiner

*Primary Examiner*—Louis K. Huynh
*Assistant Examiner*—Sameh H. Tawfik
(74) *Attorney, Agent, or Firm*—Cohen, Pontani, Lieberman & Pavane

(57) ABSTRACT

A cutting cylinder is mounted such that it can rotate and be driven and is provided with four cutting blades on its circumference, which blades divide the circumferential length into four sections arranged on the circumference of the cutting cylinder.

3 Claims, 2 Drawing Sheets

CUTTING CYLINDER FOR CROSSCUTTING A PRINTING MATERIAL WEB IN A ROTARY PRESS

BACKGROUND OF THE INVENTION

1. Field of the Invention

The invention relates to a cutting cylinder for crosscutting a printing material web in a rotary press, the cutting cylinder being mounted so that it can rotate and be driven, and being provided with cutting blades on its circumference.

2. Description of the Related Art

It is generally known to print printing material webs in a rotary press and subsequently feed them to a folder where they are separated into sections having a predetermined length by a crosscutting cylinder. These sections are called signatures. It is also possible to combine a plurality of printing material webs to form a paper stream and to cut them together with the crosscutting cylinder. Two cutting knives are generally arranged on the circumference of the crosscutting cylinder.

Crosscutting cylinders having three knives on their circumference are also known in the case of illustration printing presses. However, it is not possible to perform what is referred to as a short/long cut using cutting cylinders of this type, that is to say it is not possible for signatures having alternately different section lengths to be produced. Gathered production is therefore not possible using these cutting cylinders, because the inner signature protrudes beyond the outer signature after folding.

SUMMARY OF THE INVENTION

It is an object of the invention to improve the known cutting cylinders.

This object is achieved according to the invention by a cutting cylinder having four cutting blades arranged on the circumferential surface and dividing the circumferential length into four sections.

It is advantageously possible to achieve double the service life of the cutting knives with the same number of cut signatures as a result of the crosscutting apparatus according to the invention.

It is advantageously possible to improve the stability by configuring the crosscutting cylinder with a doubly large diameter in accordance with the invention. As a result, it is also particularly advantageously possible for signatures or printing material webs having a large number of paper layers to be cut, without the permissible deformation of the cylinder being exceeded.

In the apparatus according to the invention, the cutting process which proceeds by interaction of the cutting knife and cutting bar is performed over an advantageously relatively great distance.

The individual knives, which are actuated by spring force, have double the time to return to their initial position after each cut as a result of the advantageously extended time between the cuts.

The cutting apparatus according to the invention is particularly advantageous in a folder having a cylinder ratio of 4:7:7, that is to say a cutting cylinder according to the invention having 4 knife bars, a folding and gathering cylinder having 7 holding-blade systems and 7 folding-blade systems and also a folding-jaw cylinder having 7 folding-jaw systems interact with one another.

Large page quantities can be advantageously cut and thus produced economically using the cutting apparatus according to the invention.

The features of the present invention will be explained in greater detail in the following text using a preferred embodiment and the associated diagrammatic drawings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
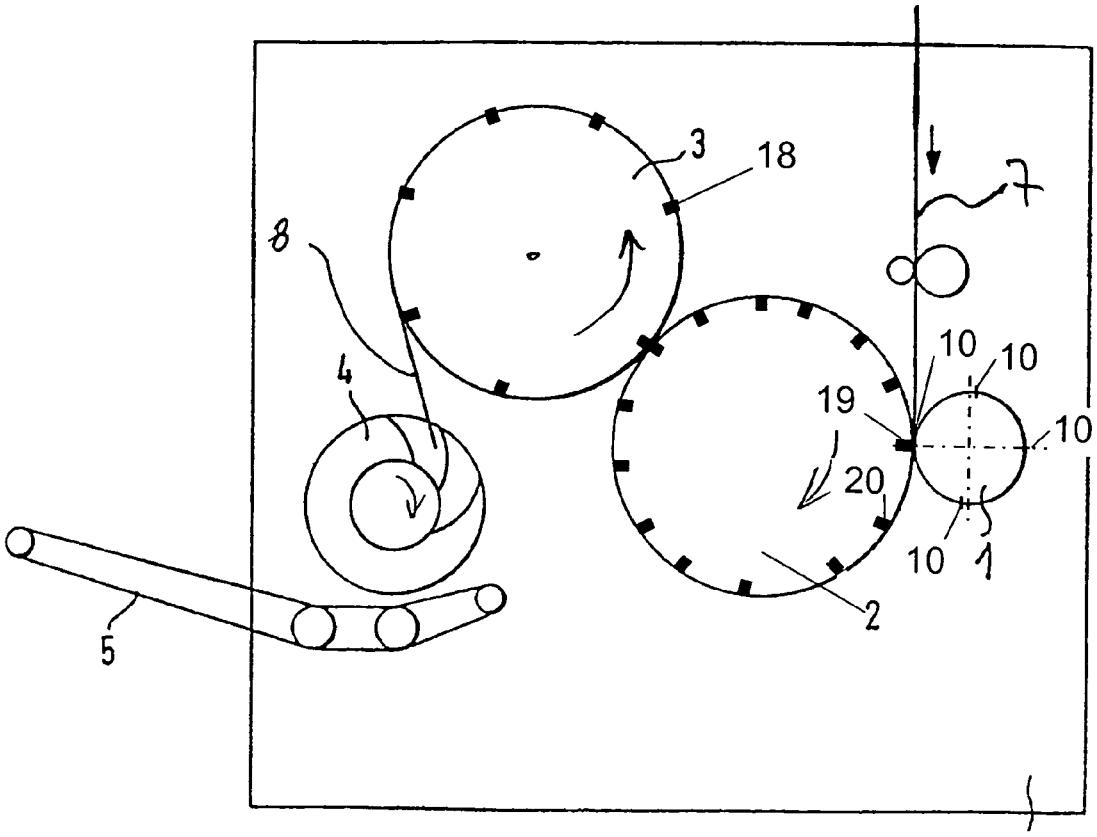
FIG. 1 shows a side view of a folder having a cuffing apparatus according to the invention.

FIG. 1 shows how a printing material web 7 runs into a folder 6 from above. Here, this can also be a paper stream having several web layers on top of one another. In addition to the perforating rolls shown (but not numbered in greater detail), it is also possible to provide pull rolls (not shown in the drawing) and further perforating rolls. The printing material web 7 is passed through between a cutting cylinder 1 and a gathering and folding cylinder 2 and is cut transversely with respect to the running direction in the process. The cutting cylinder 1 is provided with four cutting knives 10 on its circumference, so that four sections, also called signatures, are produced with every revolution. The cutting knives interact with cutting bars, the latter consisting of a soft material into which the blades can penetrate.

The severed signatures are fixed on the gathering and folding cylinder 2 by appropriate holding systems 19 and transported to the folding-jaw cylinder 3. As soon as a folding blade 20 which is arranged on the gathering and folding cylinder 2 is situated at the level of a folding jaw which is arranged on the folding-jaw cylinder 3, the folding blade extends and presses the corresponding signature into the opposite folding jaw 18 which is arranged on the folding-jaw cylinder 3, as a result of which a folded product 8 is produced. The product 8 is held securely on the folding jaw 18 and transported on the circumference of the folding-jaw cylinder 3 to the paddle wheel 4. There, the product 8 is transferred to the paddle wheel 4 which deposits the product 8 on a sheet deliverer 5.

The cutting cylinder 1 according to the invention, with its four cutting knives, is particularly advantageously effective in folders having a cylinder ratio of 4:7:7, as shown in FIG. 1. However, it is of course also possible to use the cutting cylinder in the event of other cylinder ratios and for other cutting purposes.

Figure 2:
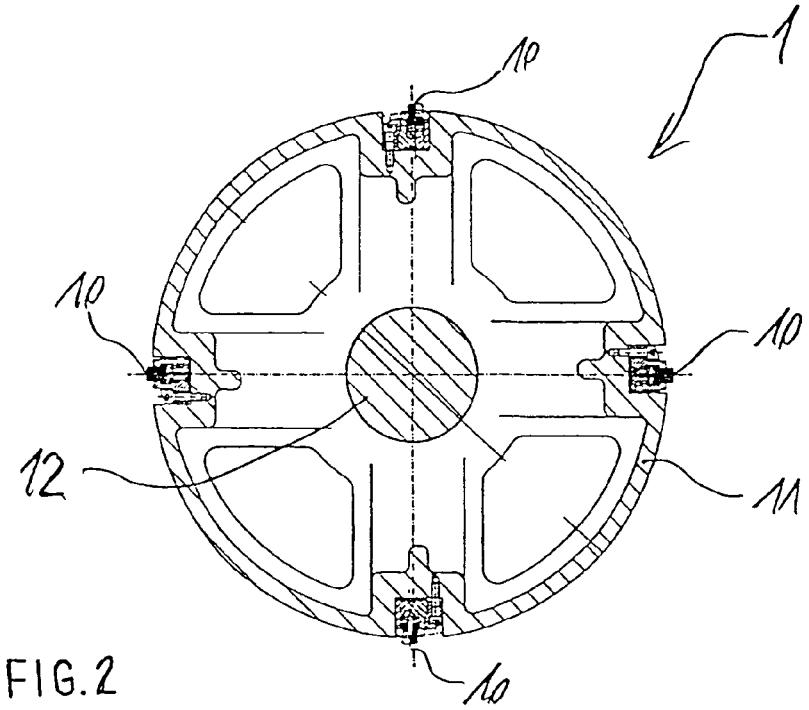
FIG. 2 represents the cross section through a cutting cylinder according to the invention.
Figure 3:
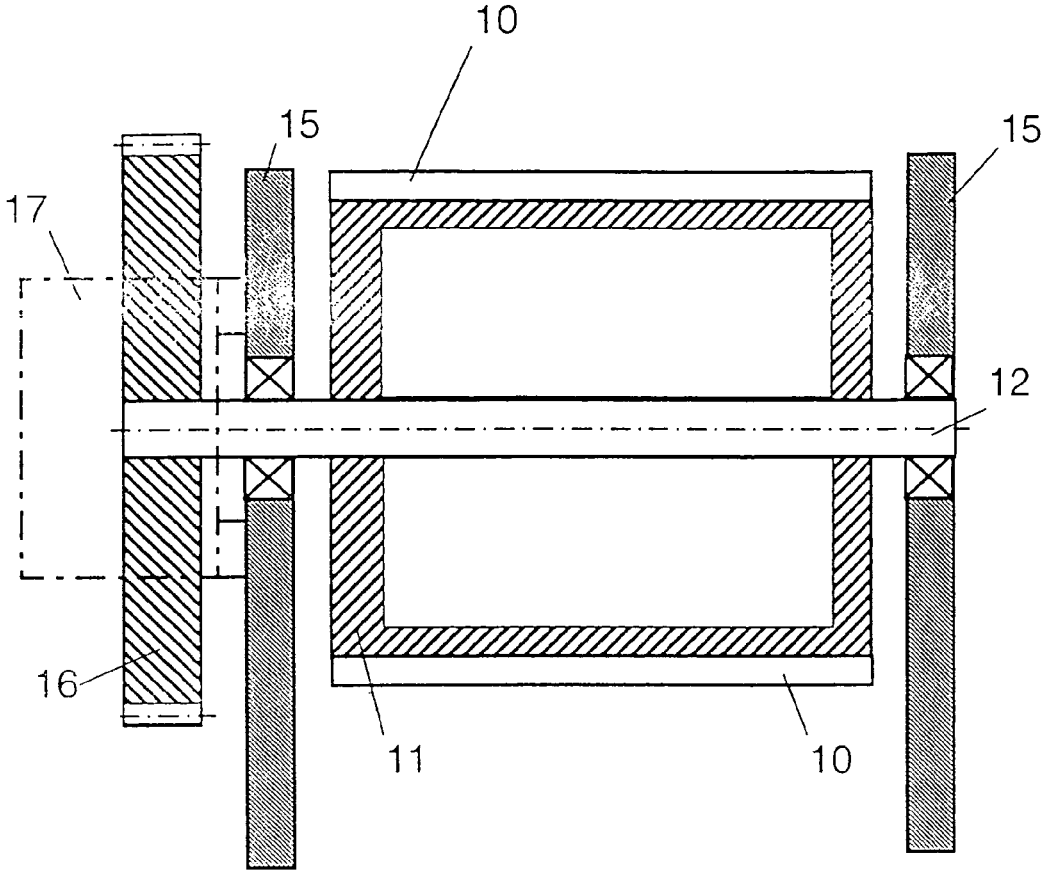
FIG. 3 shows a longitudinal section through the cutting cylinder according to the invention.

FIG. 2 shows a cross section through a cutting cylinder 1 according to the invention. The cutting cylinder 1 comprises a cylindrical basic body 11 which is arranged on a drive shaft 12. The cutting cylinder 1 is rotatably mounted with the drive shaft 12 in the side walls 15 of a folder and a gear wheel 16 can be provided for drive purposes (FIG. 3). The cutting cylinder 1 can also be driven by an electric motor 17 which is connected directly to the drive shaft 12, the electric motor being coaxial the drive shaft.

Grooves in which the cutting knives 10 are held are provided in the axial direction on the circumferential surface of the cutting cylinder 1. The cutting knives can be fastened in a conventional manner. It is possible for cutting-knife bars with spring-actuated clamping bars to be provided.

During ungathered double production, the cutting knives 10 are arranged on the circumference in such a way that the circumferential length of the cutting cylinder 1 is divided into four equally large sections, as shown in FIG. 2. For gathered production, the cutting knives 10 can be displaced appropriately in their circumferential position, so that, for example, a short section follows a long section, as shown in FIG. 1.

The relatively large diameter of the cutting cylinder 1 results in a correspondingly large section modulus and the cutting cylinder 1 can be loaded to a greater extent before the maximum permissible deflection is achieved. Furthermore, it is also possible to increase the stability of the cutting cylinder 1 by structural measures on account of the size of the said cutting cylinder 1. It is therefore possible to cut a greater number of paper layers with the cutting cylinder, which is stable and steady in accordance with the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A folder for a rotary press, the folder comprising:

a cutting cylinder for cross-cutting a printing material web, said cutting cylinder being mounted so that it can be driven for rotation, said cutting cylinder comprising a drive shaft, a circumferential surface with a circumferential length, and four cutting blades arranged on the circumferential surface and dividing the circumferential length into four sections wherein two of said sections have a first length and two of said sections have a second length which is shorter than said first length, wherein each said section having said second length follows a section in a clockwise direction having said first length, whereby said cutting cylinder can be used for gathered production; and an electric motor which is connected directly to the drive shaft.

2. A folder as in claim 1 further comprising a folding and gathering cylinder having seven holding blade systems and seven folding blade systems, and a folding jaw cylinder having seven folding jaw systems.

3. A folder as in claim 1 wherein the electric motor is coaxial to the drive shaft.

* * * * *